US007165497B2

(12) United States Patent
Gilbert et al.

(10) Patent No.: US 7,165,497 B2
(45) Date of Patent: Jan. 23, 2007

(54) TRACK SYSTEM FOR MOBILE STORAGE APPARATUS

(75) Inventors: George Glen Gilbert, Langley (CA); Howard Allen Larlee, Langley (CA); Niel Higgins, Brantford (CA)

(73) Assignee: E-Z-Rect Manufacturing Ltd. (CA)

( * ) Notice: Subject to any disclaimer, the term of this patent is extended or adjusted under 35 U.S.C. 154(b) by 389 days.

(21) Appl. No.: 10/265,134

(22) Filed: Oct. 7, 2002

(65) Prior Publication Data

US 2004/0065224 A1 Apr. 8, 2004

(51) Int. Cl.
*B61C 11/00* (2006.01)

(52) U.S. Cl. ..... 104/287; 104/242; 312/201; 312/198

(58) Field of Classification Search ..... 104/287, 104/242, 244, 243; 105/157.1, 180, 29.1; 312/198, 334, 27, 199, 201; 248/424, 429; 108/102; 211/162, 41.1
See application file for complete search history.

(56) References Cited

U.S. PATENT DOCUMENTS 3,535,009 A 10/1970 Cain
3,801,176 A 4/1974 Higbee
3,967,868 A 7/1976 Baker, Jr.
4,286,752 A 9/1981 Cheng
4,502,628 A 3/1985 Sarantitis
4,597,615 A 7/1986 Steger
4,671,184 A 6/1987 Fukuda
4,693,418 A 9/1987 Peterman
4,789,210 A 12/1988 Weiss et al.
4,802,622 A 2/1989 Homan
4,911,507 A 3/1990 Leist
4,943,169 A 7/1990 Kasai
4,944,231 A * 7/1990 Leist ..... 104/287
5,024,164 A 6/1991 Leist
5,076,715 A 12/1991 Saoyama et al.
5,105,741 A 4/1992 Leary (Continued)

FOREIGN PATENT DOCUMENTS

EP 0225858 6/1987

(Continued)

OTHER PUBLICATIONS

PiPP Mobile Storage Systems, Inc.—Installation Instruction, undated, pp. 1-19.

(Continued)

*Primary Examiner*—S. Joseph Morano
(74) *Attorney, Agent, or Firm*—Oyen Wiggs Green & Mutala LLP

(57) ABSTRACT

The invention provides longitudinally extending track support and track members for a mobile storage unit. The track support's upper surface has at least one protrusion which projects above and extends longitudinally along that upper surface. A mating recess extends within and along the track member's under surface. The recess and protrusion are sized and shaped for loose-fit longitudinal engagement of the protrusion within the recess when the track member is laid atop the track support. This permits limited transverse movement of the track member with respect to the track support, reducing susceptibility of the mobile storage unit's wheels to derailment if a transverse force is applied to mobile storage unit as it rolls along the track.

42 Claims, 23 Drawing Sheets

U.S. PATENT DOCUMENTS

| | | | | |
|---|---|---|---|---|
| 5,205,627 | A * | 4/1993 | Davison et al. | 312/201 |
| 5,435,639 | A | 7/1995 | Smits et al. | |
| 5,439,281 | A | 8/1995 | Croker | |
| 5,597,217 | A * | 1/1997 | Hoska et al. | 312/201 |
| 5,708,552 | A | 1/1998 | Han et al. | |
| 5,788,056 | A | 8/1998 | Clopton | |
| 5,943,967 | A * | 8/1999 | Sherman | 108/102 |
| 6,220,174 | B1 | 4/2001 | Gudel et al. | |
| 6,276,830 | B1 | 8/2001 | Edelmann et al. | |
| 6,681,702 | B1 * | 1/2004 | Nicely | 105/157.1 |

FOREIGN PATENT DOCUMENTS

| | | |
|---|---|---|
| EP | 0503955 | 9/1992 |
| EP | 503955 A1 * | 9/1992 |
| GB | 866206 | 4/1961 |

OTHER PUBLICATIONS

Mobile Media, Inc.—Installation Book, undated, 4 pages.

Mobile Media, Inc.—Product Brochure and Specifications entitled Mobile Storage Systems . . . , undated 24 pages.

PiPP Mobile Storage Systems, Inc.—Product Brochure entitled Top Choice of the Bottom Line, undated, 6 pages.

Tyrex Tool & Manufacturing Ltd.—Product Brochure entitled On-Track Mobile Filing Systems, undated, 4 pages.

Storage-Plus Systems Ltd.—Product Brochure entitled Storage Plus, undated, pp. 1-12.

Mizer®—Product Brochure and Specifications entitled Professional Filing Solution, undated, 14 pages.

ProSpace—Product Brochure entitled High Density Mobile Storage Systems, undated, 7 pages.

Metro Associates, A Division of Metro Office Equipment Sales Ltd.—Product Brochure and Specifications entitled METRO Create-an-Aisle High Density Mobile Storage System, undated, 14 pages.

* cited by examiner

TRACK SYSTEM FOR MOBILE STORAGE APPARATUS

TECHNICAL FIELD

This invention relates to mobile storage apparatus. Particular embodiments of the invention have application to track and wheel assemblies for mobile storage apparatus.

BACKGROUND

High rental rates and a desire to reduce operating costs have created a need for high density storage systems. Mobile storage systems meet this need by increasing storage density.

Typically, mobile storage systems incorporate a plurality of individual storage units that are moveable in relation to one another to provide convenient access to the various storage sections. Some mobile storage systems have individual storage units that move by means of a roller mechanism along a plurality of parallel, spaced apart tracks.

Typically, each individual storage unit has a base, with a number of rollers or wheels mounted thereon, and one or more storage sections. The storage sections may include shelves, hangers, drawers or the like. The rollers or wheels roll along the parallel tracks to enable movement of individual storage units. The tracks may include end-stops to limit the range of travel of the wheels.

As shown in FIG. 1A, a typical prior art mobile storage system 11 includes two substantially parallel tracks 5 and two static storage units 2, 4 fixed at opposed end of tracks 5. Typically, although not necessarily, static storage units 2, 4 abut walls 6. Mobile storage system 11 also includes a plurality of mobile storage units 10, which may be rolled back and forth in the directions indicated by double-headed arrow 3 on wheels (not shown) that engage tracks 5. The number of mobile storage units 10 in a particular mobile storage system 11 depends on the geometries of mobile storage units 10 and the available space and storage requirements of a particular application.

FIG. 1B depicts another typical prior art mobile storage system 11' having one relatively large static storage unit 2, which is oriented substantially parallel to tracks 5. Mobile storage system 11' also has a mobile storage unit 10, which rolls back and forth in the directions indicated by double-headed arrow 7 on wheels (not shown) that engage tracks 5. Although FIG. 1B depicts only one mobile storage unit 10, mobile storage system 11' may include a plurality of mobile storage units 10, the number of which depends on the applicable geometries.

Prior art designs of wheel and track assemblies and the interfaces between wheel and track assemblies associated with mobile storage systems suffer from a number of disadvantages. Notably, wheels and track surfaces wear under heavy load, as do the bearings in the wheel assemblies. Over time, such wear makes it more difficult to move the mobile storage units, necessitates costly repairs to the storage system, and causes downtime for individuals and businesses that employ such storage systems.

Another disadvantage of many prior art mobile storage systems is that debris is easily trapped in the track and wheel assemblies. Once trapped, such debris may be difficult to remove. In some applications, such as the restaurant or grocery industry, debris accumulation may be unsanitary and unacceptable.

A third disadvantage of prior art mobile storage systems is that there may be excessive wear or damage to the surface on which tracks are mounted. Over time, repetitive movement of a heavily loaded mobile storage system will wear the surface on which the tracks are mounted.

There is a need for a mobile storage system which ameliorates at least some of the disadvantages of the prior art.

SUMMARY OF INVENTION

The invention provides longitudinally extending track support and track members for a mobile storage unit. The track support's upper surface has at least one protrusion which projects above and extends longitudinally along that upper surface. A mating recess extends within and along the track member's under surface. The recess and protrusion are sized and shaped for loose-fit longitudinally extending engagement of the protrusion within the recess when the track member is laid atop the track support. This permits limited transverse movement of the track member with respect to the track support, reducing susceptibility of the mobile storage unit's wheels to derailment if a transverse force is applied to the mobile storage unit as it rolls along the track.

A pair of parallel slots extend longitudinally within and along the track member's upper surface. The transverse cross-sectional shape of the track member's upper surface may be such that the slots slope outwardly and downwardly away from one another; or, such that the slots slope inwardly and downwardly toward one another. Longitudinally extending wear strips can be inserted into each slot to serve as replaceable wear surfaces along which the mobile storage unit's wheels roll.

If the track member has the first of the two transverse cross-sectional shapes mentioned in the previous paragraph, then the mobile storage unit's wheels may have circumferentially grooved rims and inwardly bevelled circumferential sides. The wheel's sides are positionable within the track member's first and second slots respectively, such that the wheel may roll along the track member without substantial contact between its rim and the track member at points away from the wheel's sides.

If the track member has the other transverse cross-sectional shape, then each wheel may have a flat circumferential rim extending between spaced apart first and second circumferential sides of the wheel. That wheel's sides are positionable within a concave channel formed in the track member's upper surface by the inwardly and downwardly sloped slots, without substantial contact between the wheel's rim and the track member at points away from the wheel's sides.

DESCRIPTION

Throughout the following description, specific details are set forth in order to provide a more thorough understanding of the invention. However, the invention may be practised without these particulars. In other instances, well known elements have not been shown or described in detail to avoid unnecessarily obscuring the invention. Accordingly, the specification and drawings are to be regarded in an illustrative, rather than a restrictive, sense.

Figure 1A:
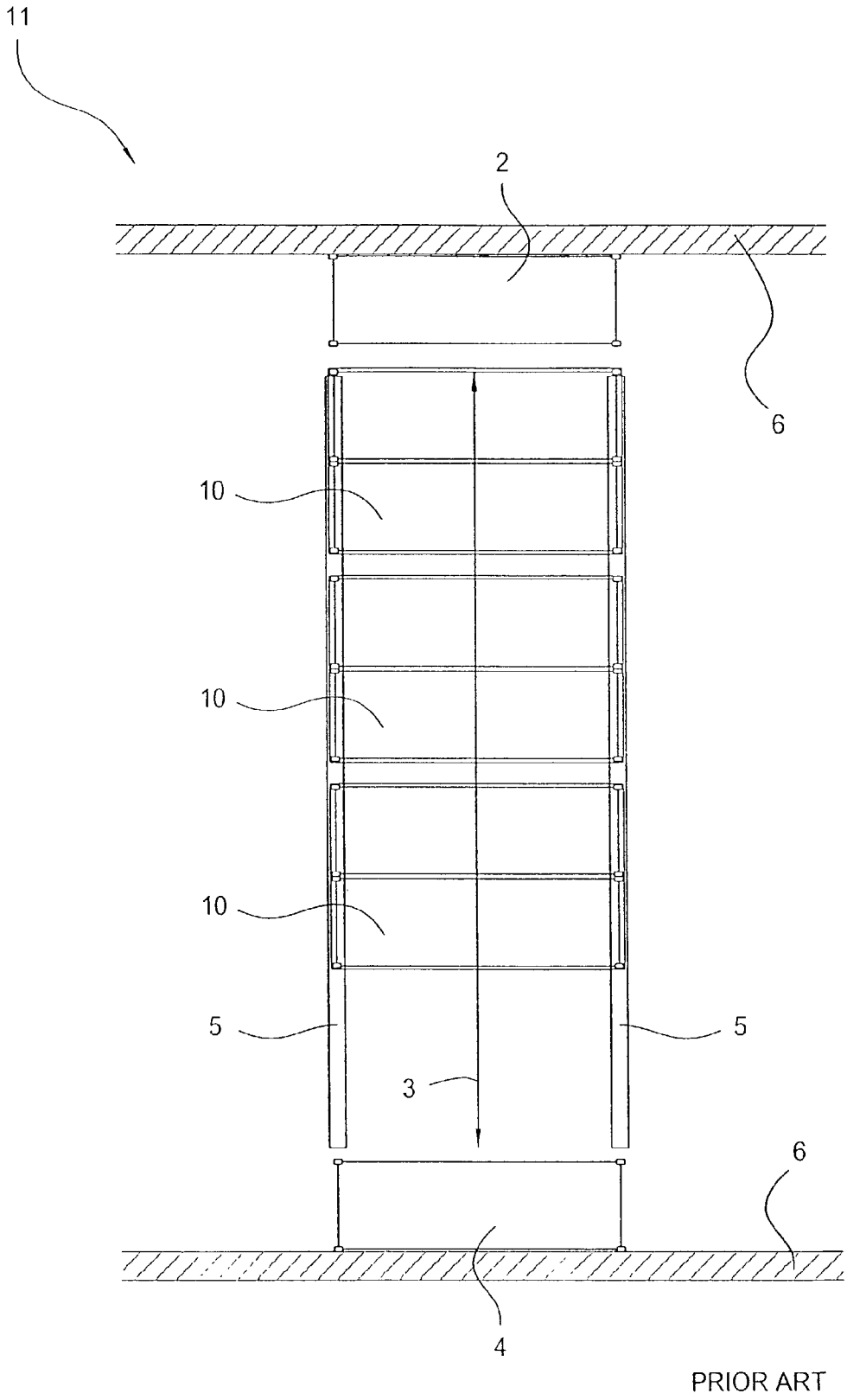
FIGS. 1A and 1B are top plan schematic depictions of first and second embodiments respectively of typical prior art track-based mobile storage systems.
Figure 1B:
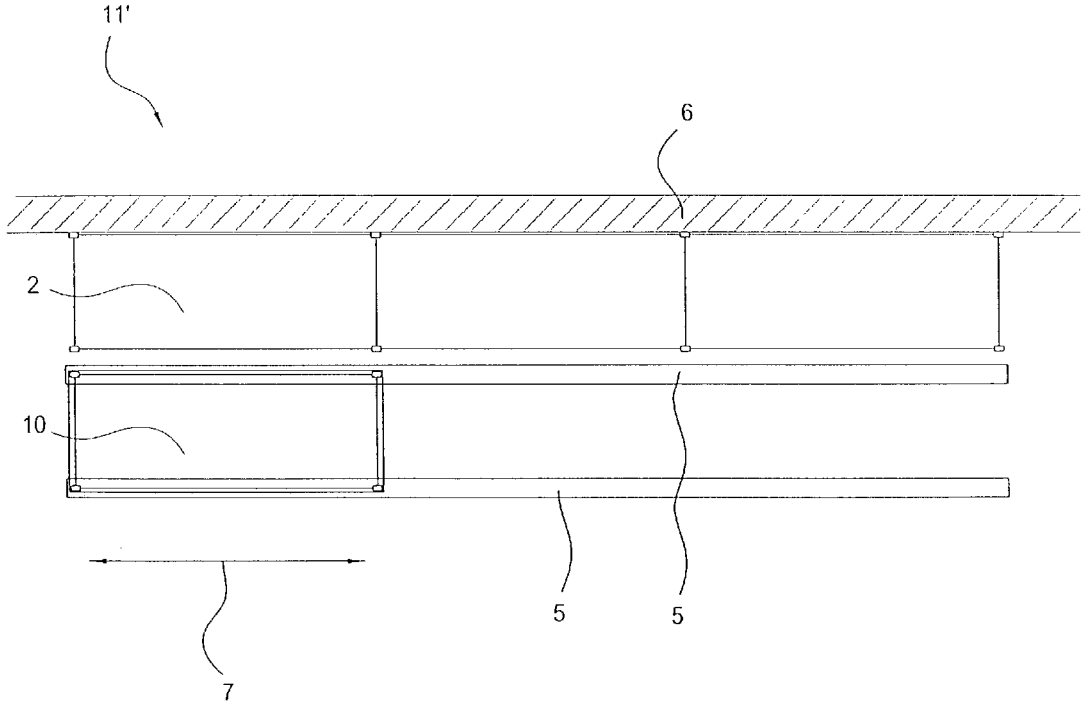
PRIOR ART FIGURE 1B
Figure 2:
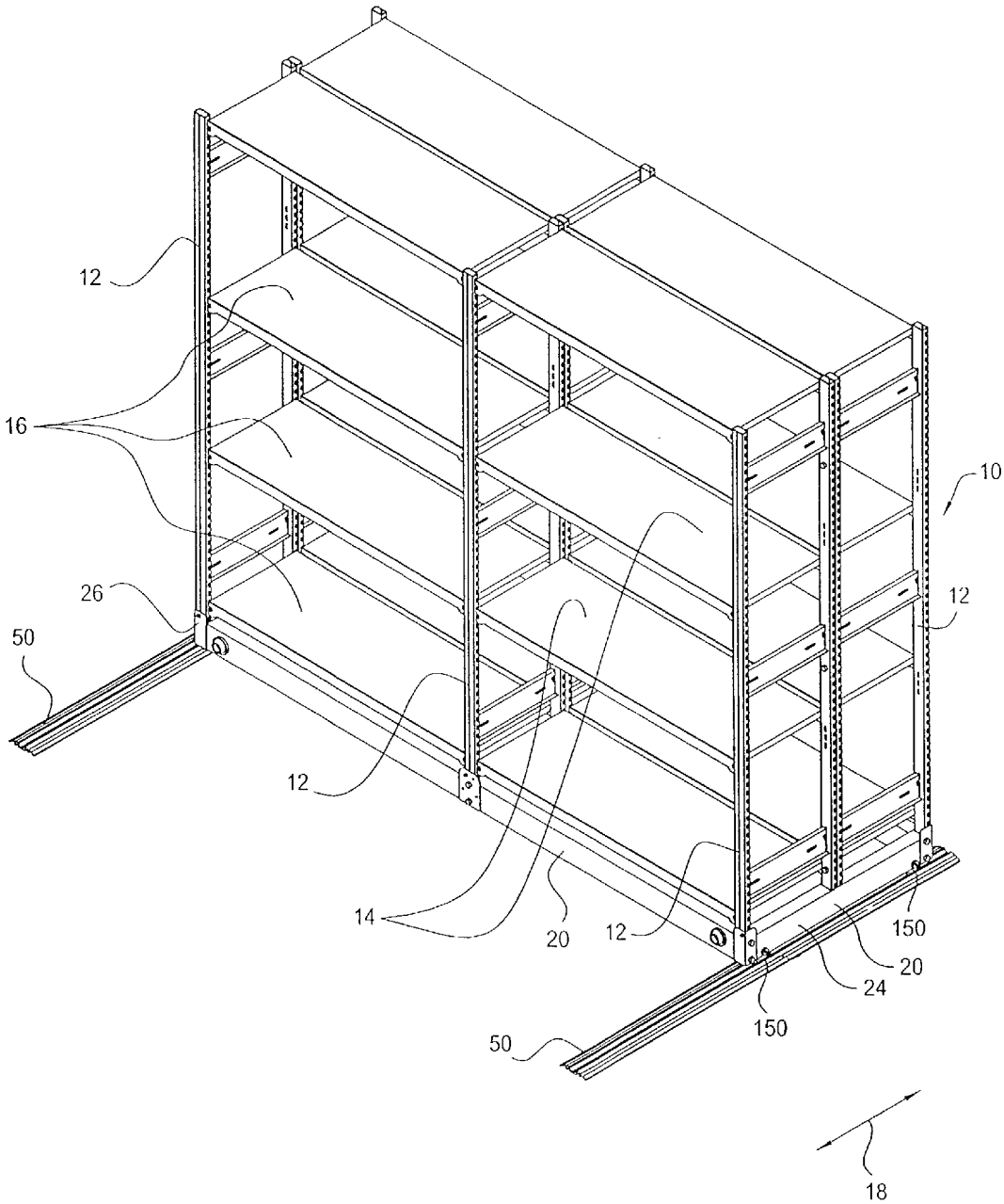
FIG. 2 is an isometric view of one embodiment of an individual mobile storage unit for a mobile storage system according to the invention.

FIG. 2 depicts one possible embodiment of a mobile storage unit 10 configured for use in a mobile storage system according to the invention. Mobile storage unit 10 has a base 20 and a plurality of wheels 150 which facilitate rolling movement of mobile storage unit 10 along a pair of substantially parallel tracks 50. Mobile storage unit 10 can be rolled along tracks 50 in either of the directions indicated by double-headed arrow 18. This is typically accomplished by grasping mobile storage unit 10 and pushing or pulling it to propel it along tracks 50. As mobile storage unit 10 approaches its intended destination along tracks 50 an oppositely directed pushing or pulling force may be applied to decelerate mobile storage unit 10 to a stop.

Base 20 of mobile storage unit 10 supports one or more storage sections 16. Storage sections 16 may include shelves, drawers, hanging units, liquid storage containers, merchandise display units and the like. In the illustrated embodiment, base 20 of mobile storage unit 10 supports a number of vertical members 12, which together support a plurality of shelves 14 connected between vertical members 12.

Figure 3:
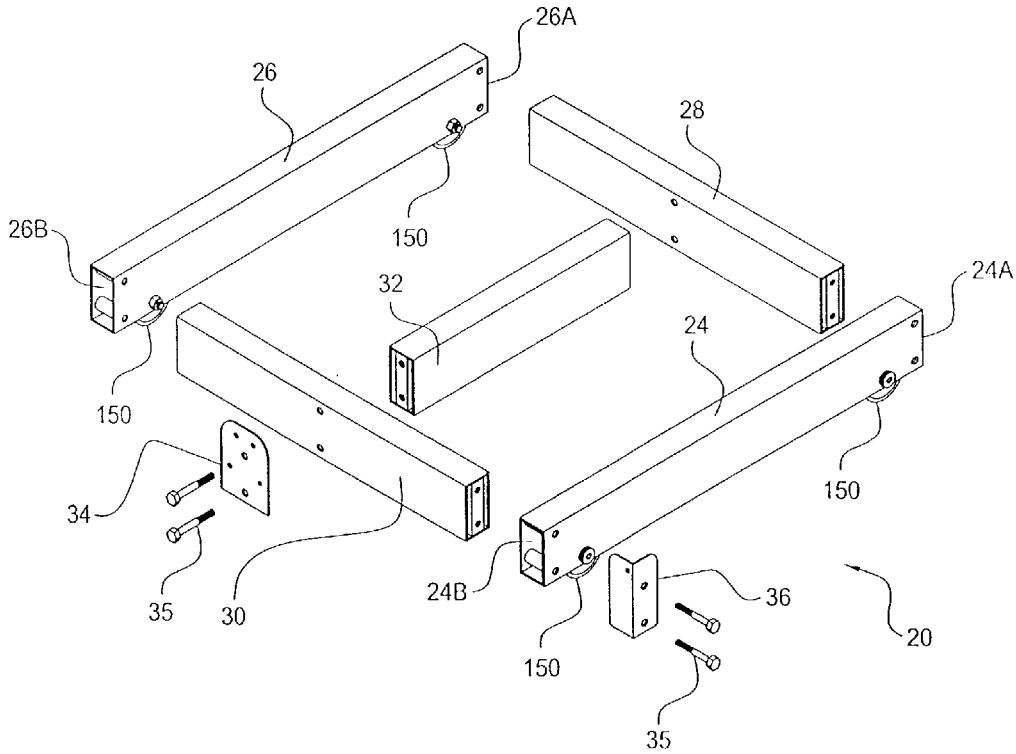
FIG. 3 is an exploded isometric view of the base of the mobile storage unit of FIG. 2.

FIG. 3 depicts one possible configuration of base 20 that may form a part of the mobile storage unit 10 of FIG. 2. First wheel supporting member 24 and second wheel supporting member 26 are longitudinal in shape and extend substantially parallel to tracks 50 (see FIG. 2). In the illustrated embodiment, first and second wheel supporting members 24, 26 are substantially hollow, such that they may contain wheel assemblies 150. First wheel supporting member 24 rotatably supports a first wheel assembly 150 at first end 24A and rotatably supports a second wheel assembly 150 at opposed second end 24B. Similarly, second wheel supporting member 26 rotatably supports first wheel assembly 150 at first end 26A and rotatably supports second wheel assembly 150 at opposed second end 26B. Wheel assemblies 150 are typically identical to one another and are described in greater detail below.

Structural cross-members 28, 30 are connected transversely between wheel supporting members 24, 26 by corner plates 36 and fasteners 35. For the sake of clarity, FIG. 3 depicts only one corner plate 36 and one set of fasteners 35, which attach structural cross-member 30 to end 24B of wheel supporting member 24. It will be appreciated by those skilled in the art, that the other corners of base 20 may be attached to one another using similar corner plates and fasteners. Opposed ends of an additional structural member 32 can be fixed transversely between structural cross-members 28, 30 by plate 34 and fasteners 35.

Figure 4:
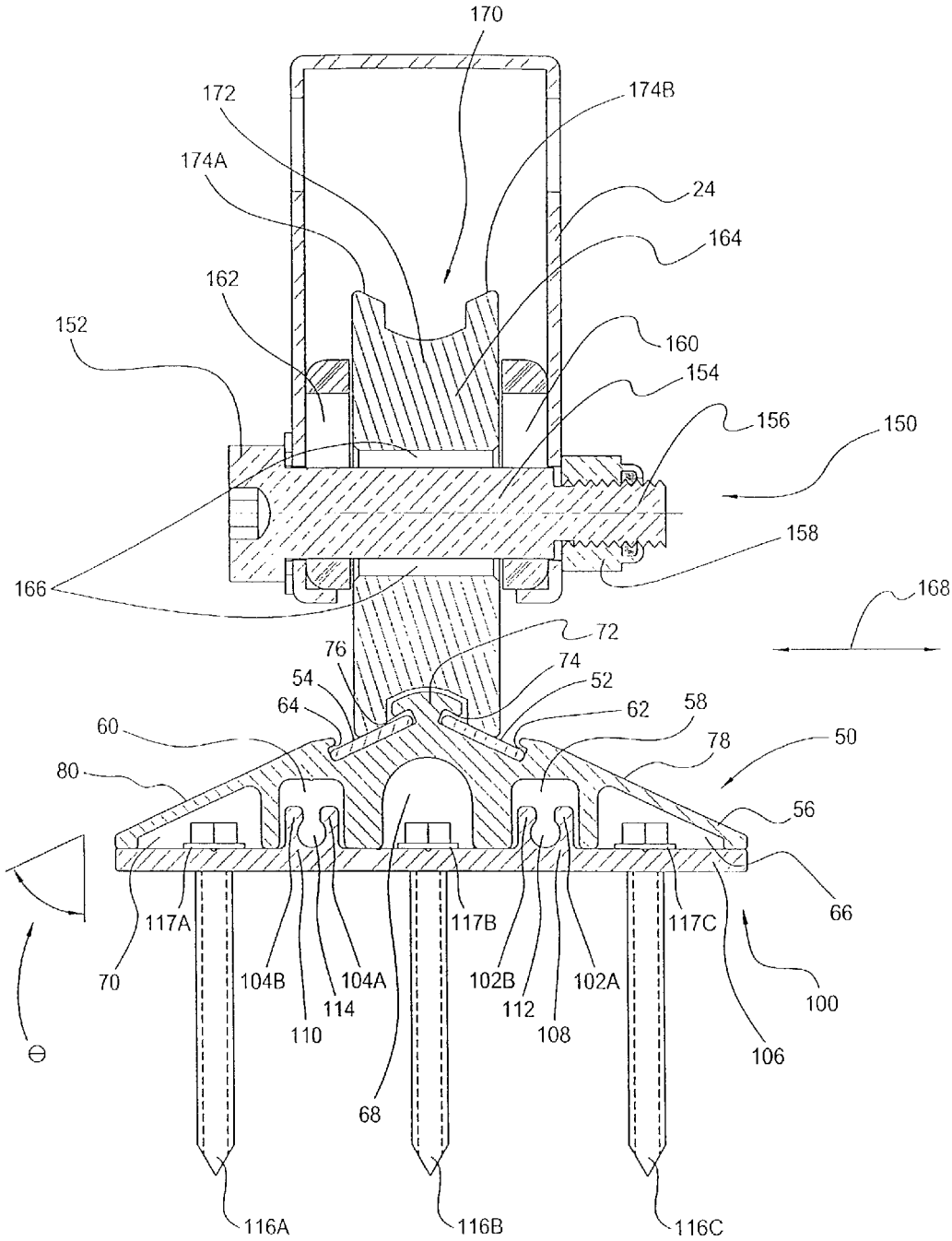
FIG. 4 is a sectional front elevation view of one embodiment of a wheel assembly, track assembly and track support for the mobile storage system of FIG. 2.
Figure 5A:
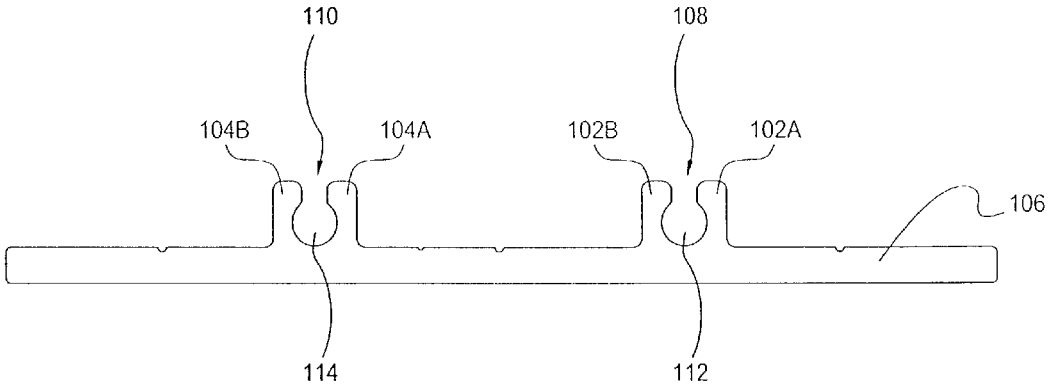
FIG. 5A is a front elevation view of the FIG. 4 track support.
Figure 5B:
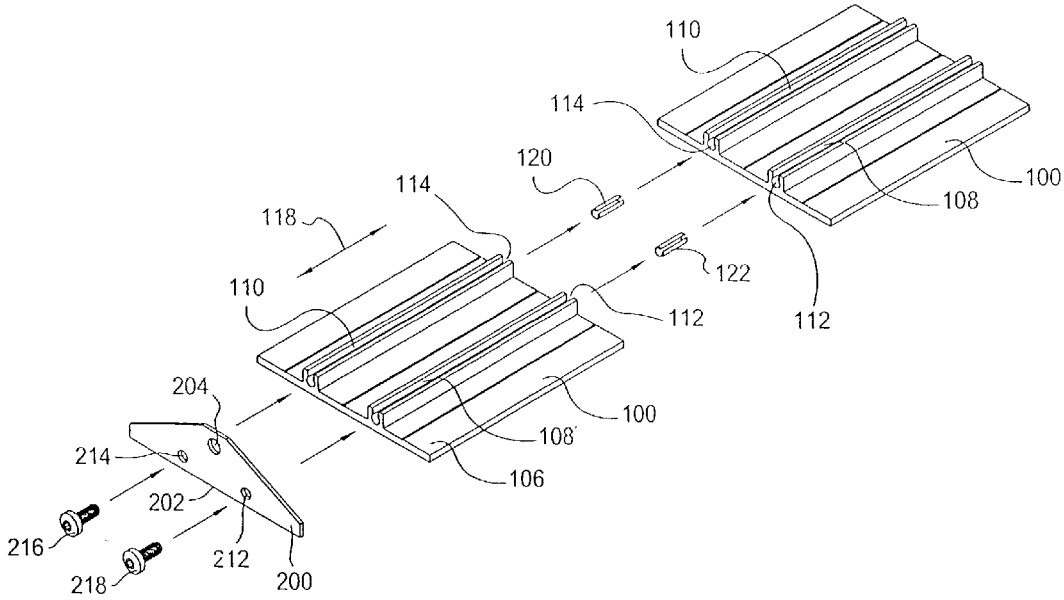
FIG. 5B is an isometric view of track support, end-plate and spring clip components of the FIG. 4 apparatus.

As seen in FIGS. 4, 5A and 5B, track support 100 includes a substantially flat-bottomed base member 106 that is elongated in the direction of arrow 18 (see FIG. 5B). Protrusions 108, 110, project above, and extend longitudinally along the entire length of base member 106. Protrusion 108 has two opposed arms 102A, 102B. Protrusion 110 has two opposed arms 104A, 104B. Arms 102A, 102B are shaped to define a partial cavity 112, which is substantially semicircular in cross-section. Similarly, arms 104A, 104B are shaped to define a partial cavity 114, which is also substantially semi-circular in cross-section.

Track support 100 is mounted on a support surface (not shown). Typically, the support surface under track support 100 is roughly horizontal (such as a concrete warehouse floor), but a horizontal support surface is not essential to implement the invention. Some support surfaces may be made horizontal through the addition of shims (not shown) positioned under track support 100. In the illustrated embodiment (see FIG. 4), track support 100 is mounted to the support surface by a plurality of hex-head screws 116A, 116B, 116C, which are positioned at spaced apart locations (not shown) along the length of base member 106. FIG. 4 depicts three possible locations for hex-head screws 116A, 116B, 116C along the transverse cross-section of track support 100. Hex-head screws 116A, 116B, 116C need not be countersunk. Hex-head screws 116A, 116B, 116C respectively include flanges 117A, 117B, 117C, which bear against a non-width reduced portion of track support 100. In general, hex-head screws 116A, 116B, 116C, may be replaced by other suitable fasteners, such as pan-head screws, flat-head screws, concrete bolts, nails and/or double-sided tape.

The choice of fasteners depends, inter alia, on the support surface to which track support 100 is mounted.

Preferably, track support 100 is made of light-weight and durable extruded aluminum. However, track support 100 could also be made from other materials, such as titanium, other metals, alloys, polymers, ceramics and composites.

Individual pieces of track support 100 are fabricated in a desired length. In some applications, the length required for a mobile storage system may exceed the length of the individual pieces of track support 100. In such cases, two or more pieces of track support 100 may be joined to one another by spring clips 120, 122 as shown in FIG. 5B. Spring clips 120, 122 are compressed and partially inserted into each of partial cavities 112, 114 of adjacent, longitudinally-aligned pieces of track support 100. When spring clips 120, 122 expand, they secure the adjacent pieces of track support 100 in longitudinal alignment with one another.

Figure 6A:
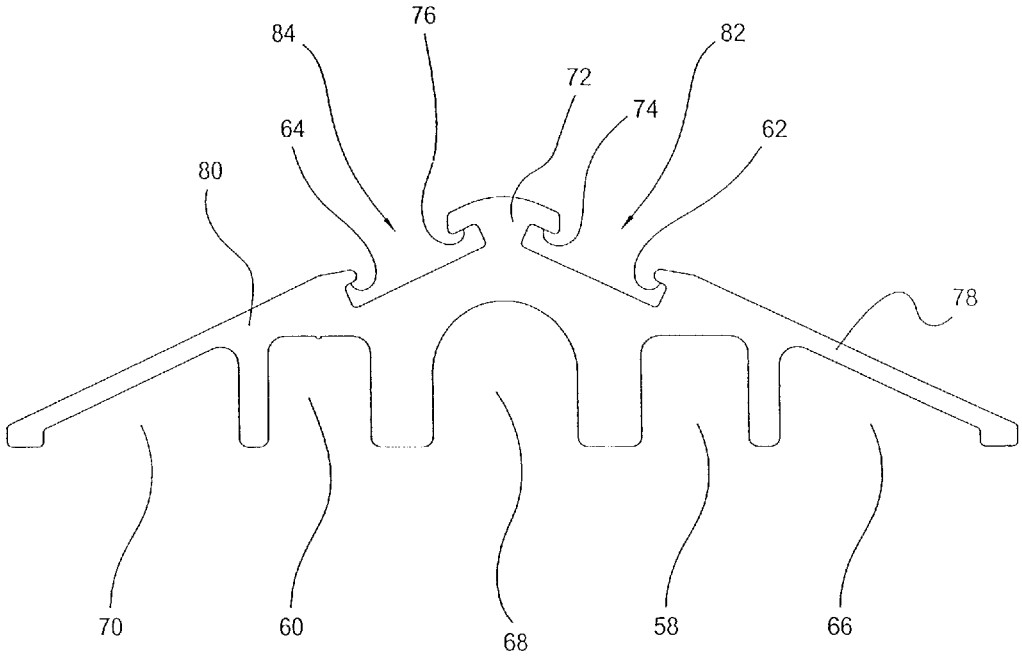
FIG. 6A is a front elevation view of the FIG. 4 track member.
Figure 6B:
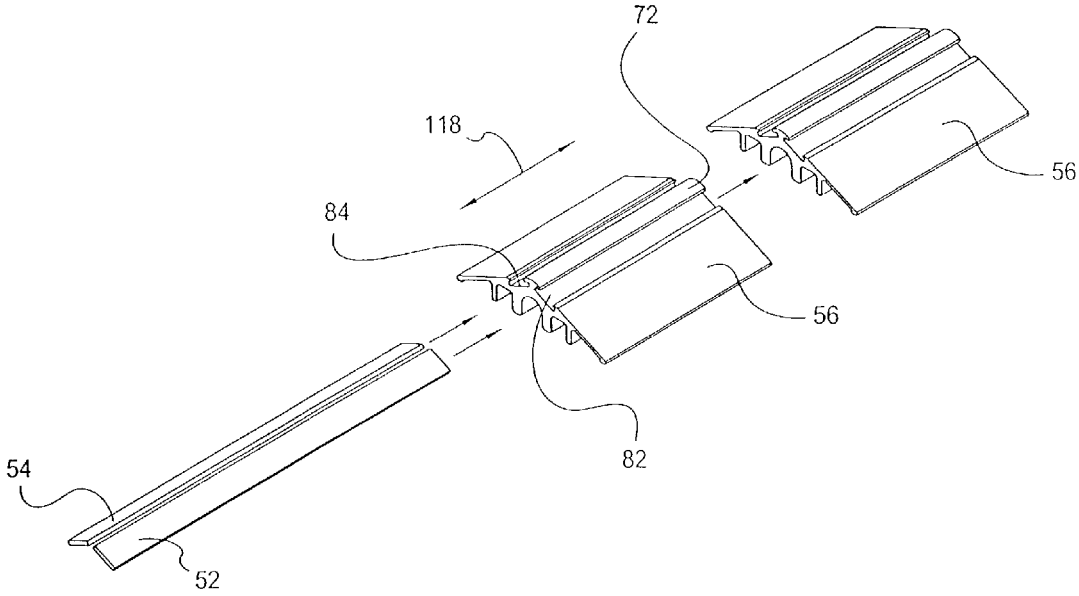
FIG. 6B is an isometric view of track members and steel strip insert components of the FIG. 4 apparatus.

Track member 56 is elongated in the direction of arrow 18 (see FIG. 6B). Preferably, track member 56 is made of light-weight but durable extruded aluminum; however, it could also be fabricated from other materials, such as titanium, other metals, alloys, polymers, ceramics and composites. The top surface of track member 56 has two opposing longitudinally extending surfaces 78, 80, which are sloped outwardly and downwardly away from one another. Two slots 82, 84 (one in each of surfaces 78, 80) in the top surface of track member 56 are also sloped outwardly and downwardly away from one another. The top surface of track member 56 is surmounted by convex head 72. The overall convex shape of the top surface of track member 56 (best seen in FIG. 4) is advantageous, because it tends to cause debris to slide downwardly off of and away from the components of track support 100, track assembly 50, and wheel assembly 150. This shape is useful in the food service and grocery industries, where sanitation is of utmost concern and the debris accumulation is extremely undesireable.

As shown in FIG. 6B, wear strips 52, 54 are slidably inserted into slots 82, 84 respectively. Strip 52 is secured in place by flange 62 of slanted surface 78 and flange 74 of head 72 (see FIG. 4). Similarly, strip 54 is secured by flanges 64, 76. Preferably, wear strips 52, 54 are made of relatively durable material, such as steel, but they may also be made of other materials, such as titanium, other metals, alloys and composites. As can be seen in FIG. 4, wheel assemblies 150 roll on wear strips 52, 54. Wear strips 52, 54 may also be used to join together and align adjacent sections of track member 56 by inserting wear strips 52, 54 into slots 82, 84 of an opposed pair of end-butted track members, such that wear strips 52, 54 extend into slots 82, 84 of track members 56 on either side of the butt joint.

A plurality of cavities 66, 68, 70 (see FIG. 6A) are formed in the under surface of track member 56. As seen in FIG. 4, recesses 66, 68, 70 provide space for the heads of hex-head screws 116A, 116B, 116C which are used to mount track support 100 to the surface. Cavities 66, 68, 70 avoid the need to counter-sink the hex-head screws into track support 100. Because no countersinking into track support 100 is required, a thicker portion of track support 100 is secured between flanges 117A, 117B, 117C and the support surface, providing a more durable and robust connection between track support 100 and the support surface, and reducing potential wear and damage to the support surface.

Figure 7A:
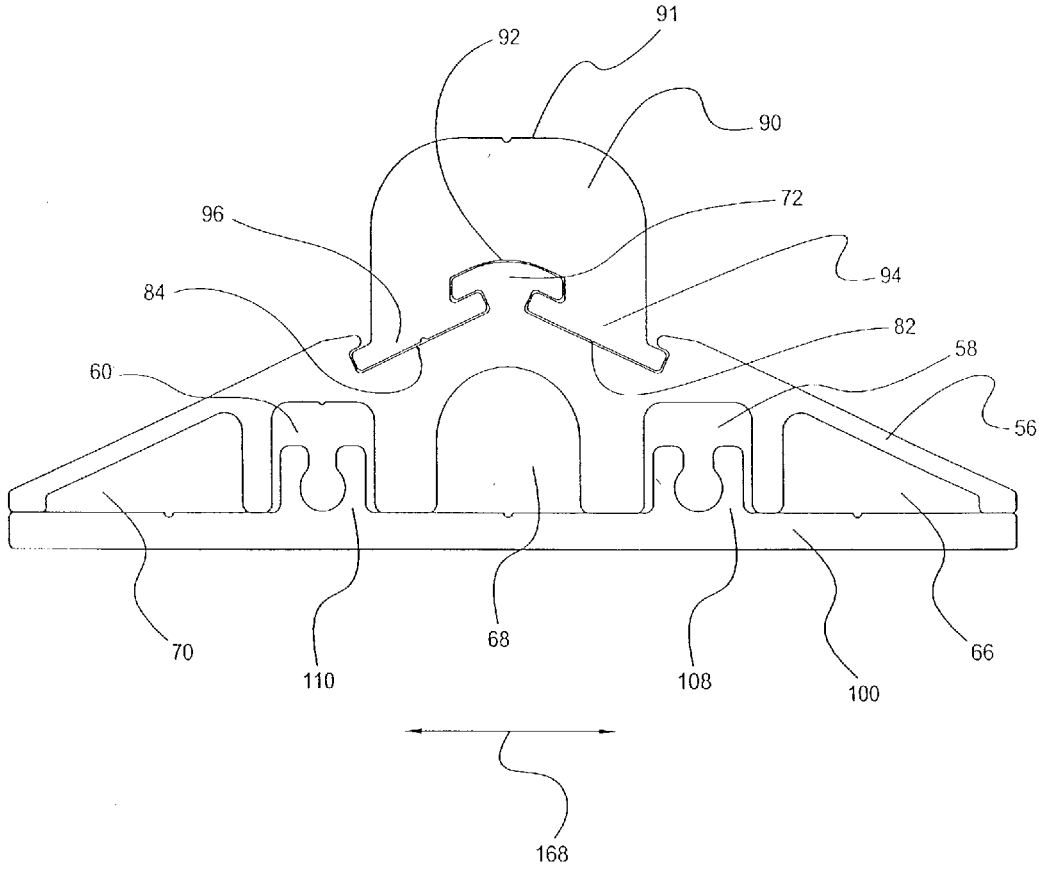
FIG. 7A is a front elevation view of track member, end-stop and track support components of the FIG. 4 apparatus.

Referring to FIG. 7A, track member 56 is laid atop track support 100. Preferably, track member 56 is not fixed to track support 100. Longitudinally extending recesses 58, 60 in the under surface of track member 56 provide clearance for protrusions 108, 110 respectively. Recesses 58, 60 are slightly wider than protrusions 108, 110 for loose-fit projection of protrusions 108, 110 within, and extension along, recesses 58, 60 when track member 56 is laid atop track support 100. Because track member 56 is not fixed to track support 100 and because recesses 58, 60 are slightly wider than protrusions 108, 110, track member 56 can move transversely (in the directions indicated by double-headed arrow 168) by a limited amount with respect to track support 100.

Typically, the range of movement provided by the difference in the transverse width dimensions of recesses 58, 60 and protrusions 108, 110 is within a range of about 1–5 mm. The ability of track member 56 to move transversely with respect to track support 100 prevents derailment of mobile storage unit 10 if a transverse force is applied to mobile storage unit 10. The ability of track member 56 to move transversely with respect to track support 100 also eases start-up of rolling motion of mobile storage unit 10, even if mobile storage unit 10 is heavily loaded or if track assemblies 50 are not in perfect parallel alignment. The limited transverse movement capability of track member 56 with respect to track support 100 also reduces torque and wear on track assembly 50 and wheel assembly 150.

Figure 7B:
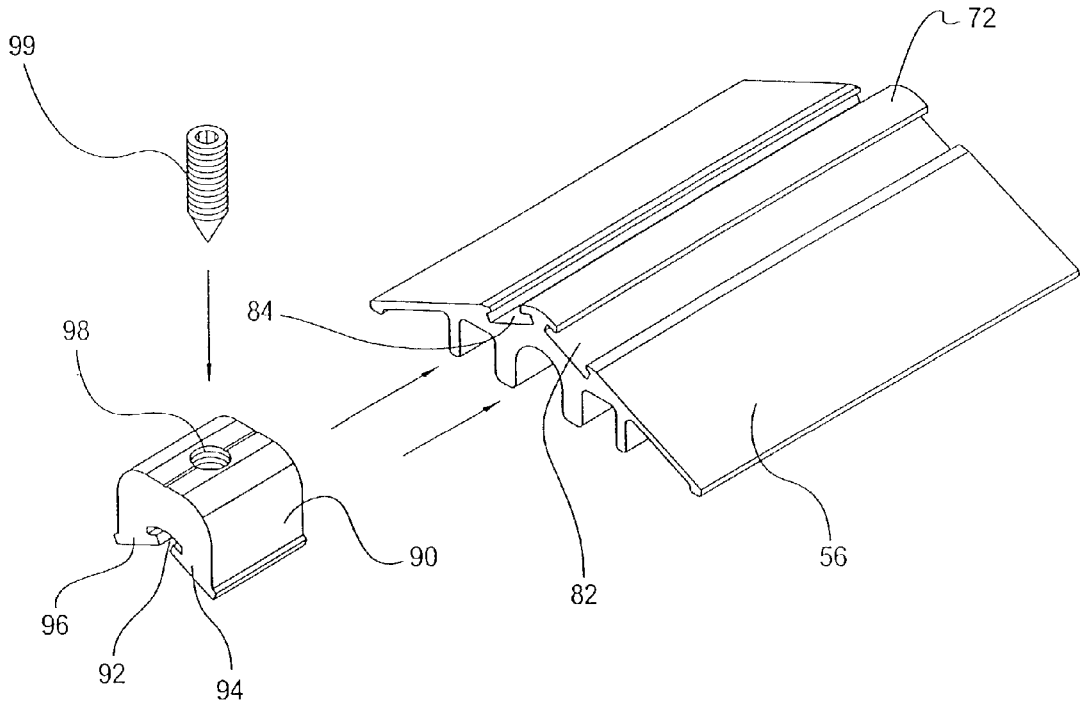
FIG. 7B is an isometric view of track member and end-stop components of the FIG. 4 apparatus.

As seen in FIGS. 7A and 7B, end-stop 90 has a top surface 91 and a bottom surface shaped to engage track member 56. Specifically, recess 92 is sized and shaped to slide over head 72 and legs 94, 96 are sized and shaped to slide respectively into slots 82, 84 of track member 56. This allows end-stop 90 to be slidably mounted at any desired location on track member 56. Screw 99 is threadably fastened through threaded aperture 98, to drive the screw's sharp tip into head 72 of track member 56. In addition to fastening end-stop 90 to head 72, screw 99 secures the position of end-stop 90 by forcing legs 94, 96 against flanges 62, 64, 74, 76 (see FIG. 6A) of slots 82, 84, so that end-stop 90 may stop the travel of wheel assembly 150 without requiring fixation to the surface or to track support 100.

End-stop 90 (including recess 92 and legs 94, 96) is preferably made of light-weight and durable aluminum, but other materials may be used, such as titanium, other metals, alloys, polymers, ceramics and composites. Preferably, an elastomeric bumper (not shown) is glued or otherwise bonded to end-stop 90 to cushion the impact of wheel assembly 150 when it contacts end-stop 90.

Figure 8:
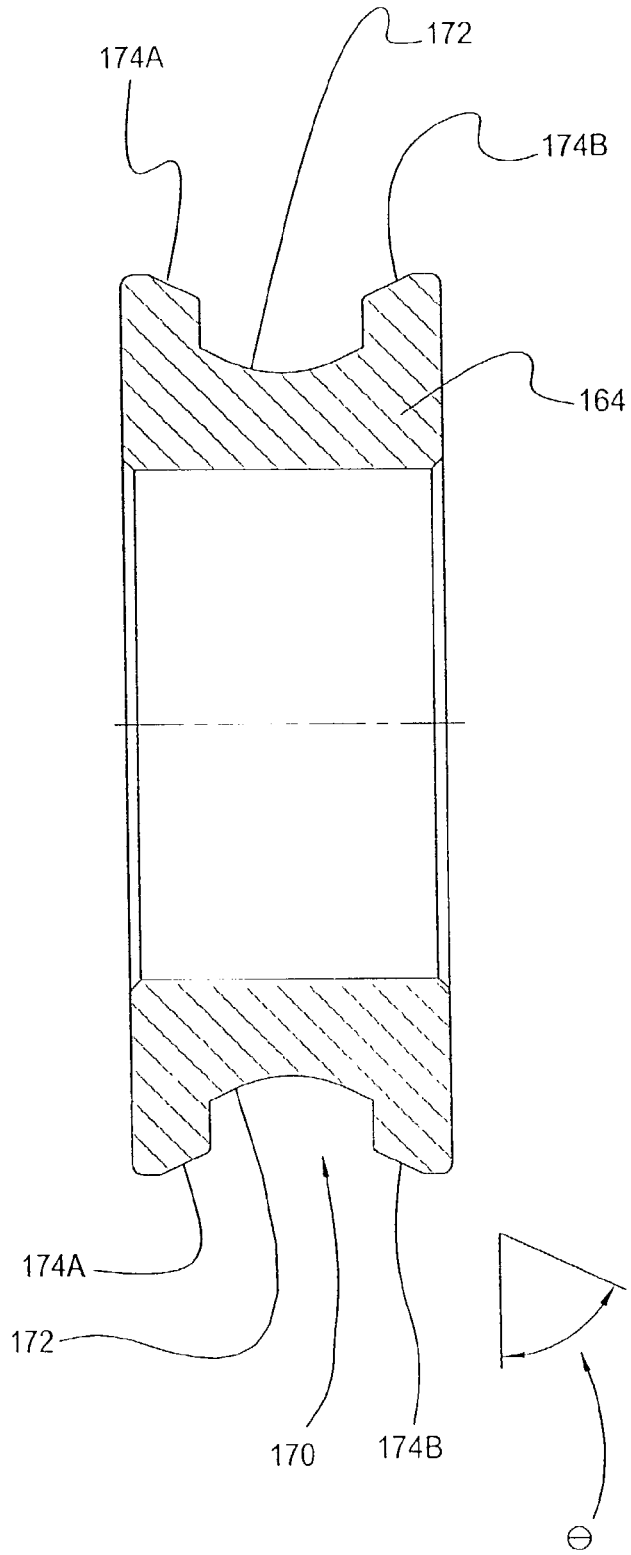
FIG. 8 is a sectional front elevation view of a wheel body component of the FIG. 4 apparatus.

Wheel assembly 150 is rotatably mounted within wheel support member 24 by axle bolt 152 and nut 158 (see FIG. 4). Nut 158 is screwed onto threaded end 156 of bolt 152, which has a smooth-surfaced cylindrical central section 154. Bolt 152 extends through wheel supporting member 24, spacers 160, 162 and through circular aperture 166 in a bearing (not shown) housed in wheel body 164 (see FIG. 8). In general, wheel assembly 150 may include any suitably sized bearing capable of operating under the load conditions imposed on mobile storage unit 10.

Preferably, a small amount of play is left between wheel body 164, spacers 160, 162 and the walls of wheel supporting member 24, to allow wheel assembly 150 to move transversely (in the directions indicated by double-headed arrow 168) along the smooth cylindrical surface 154 of bolt 152. In the preferred embodiments, the amount of play may be approximately 2.5–4 mm. This play further eases start-up of rolling movement of mobile storage unit 10, helps offset imprecise track alignment and reduces torque and wear imposed on the components of track assembly 50 and wheel assembly 150.

The circumferential rim 170 of wheel body 164 is shaped to conform to sloped slots 82, 84 and head 72 of track member 56. Specifically, first and second circumferential sides 174A, 174B are inwardly bevelled, such that their angular orientation θ (see FIG. 8) matches that of slots 82, 84. This permits wheel assembly 150 to roll along wear strips 52, 54 with first and second circumferential sides 174A, 174B contacting wear strips 52, 54 respectively. Curved recess 172 in circumferential rim 170 is sufficiently deep and is suitably shaped, so that when first and second circumferential sides 174A, 174B roll along wear strips 52, 54, head 72 of track member 56 fits inside recess 172 (see FIG. 4). With this configuration, there is no substantial contact of circumferential rim 170 with track member 56 at any points of rim 170 located away from first and second circumferential sides 174A, 174B. The weight of mobile storage unit 10 rests on wear strips 52, 54 and no weight is borne by head 72 of track member 56.

Figure 9A:
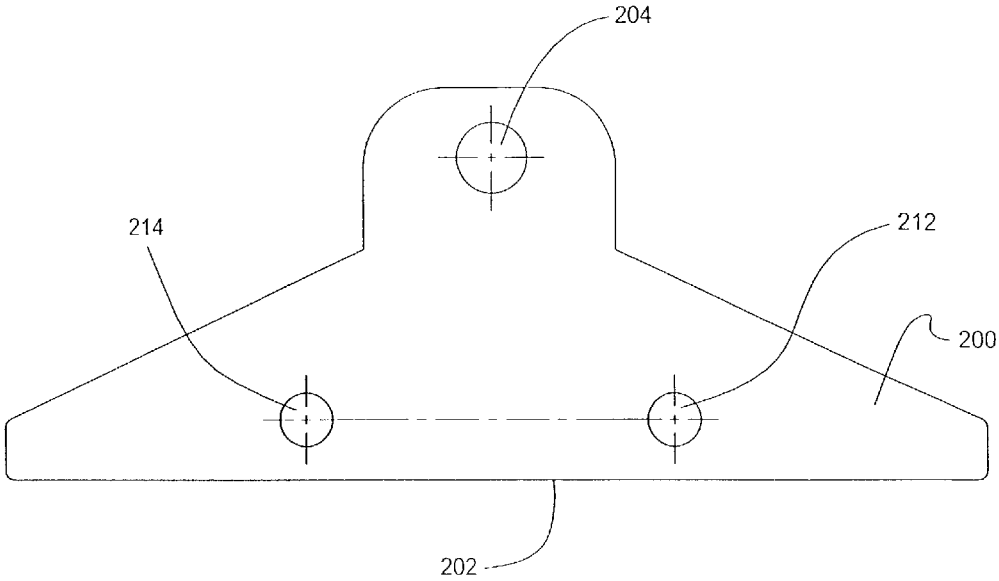
FIG. 9A is a front elevation view of an end-plate component of the FIG. 4 apparatus.
Figure 9B:
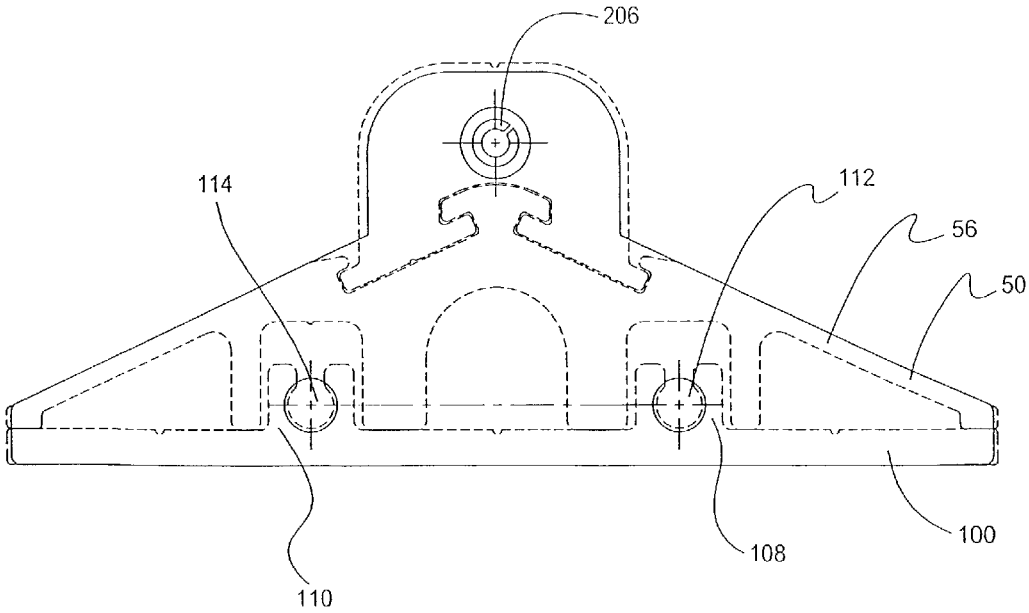
FIG. 9B is a partially sectioned front elevation view of end-plate, track support, track member and end-stop components of the FIG. 4 apparatus.
Figure 9C:
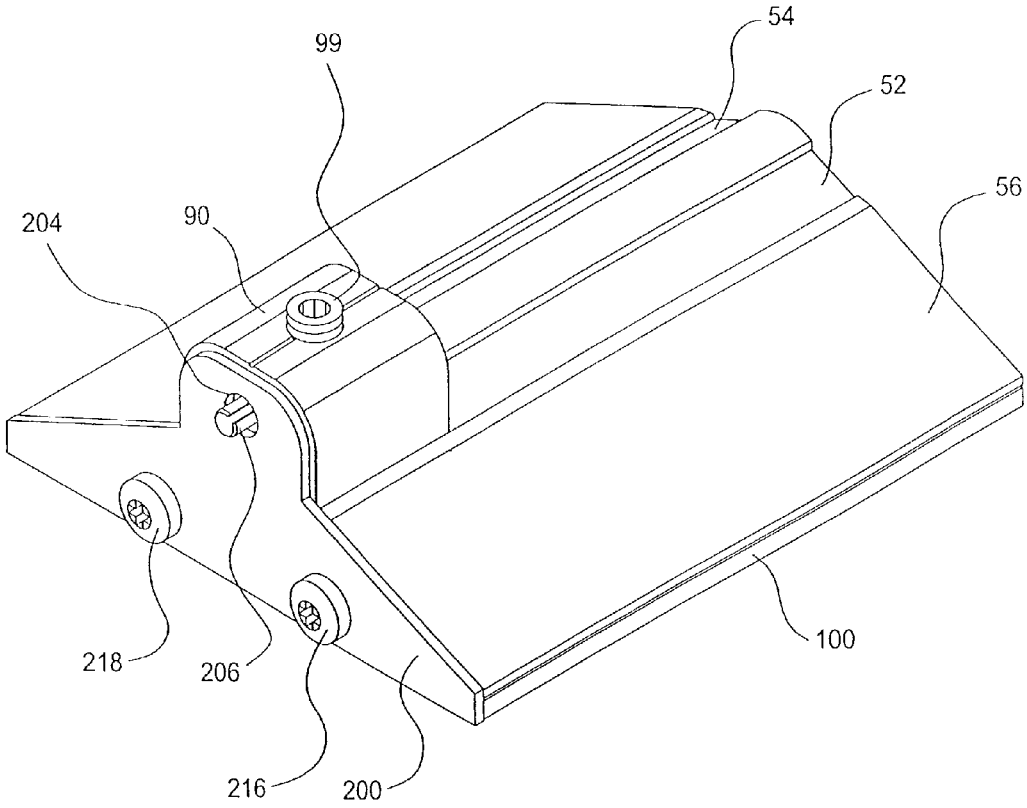
FIG. 9C is an isometric view of end-plate, track support, track member and end-stop components of the FIG. 4 apparatus.

As seen in FIGS. 9A, 9B and 9C, end-plate 200 can be provided to coincide (or approximately coincide) with the position of end-stop 90 and with the ends of track assembly 50 and track support 100. End-plate 200 is planar and has a flat bottom surface 202. If end-stop 90 coincides with the end of track assembly 50 and track support 100, end-plate 200 is mounted to track support 100 by screwing fasteners such as self-tapping screws 216, 218 (see FIG. 9C) through apertures 212, 214 into partial cavities 112, 114 formed in protrusions 108, 110. The outer end of end-stop 90 is fitted with a longitudinally protruding stud 206, which projects through aperture 204 in end-plate 200 to prevent track member 56 from lifting off of track support 100.

FIGS. 10 through 13C depict an alternative wheel assembly 150' and track assembly 50'. Wheel assembly 150' and track assembly 50' may be used in the place of wheel assemblies 150 and track assemblies 50.

Figure 10:
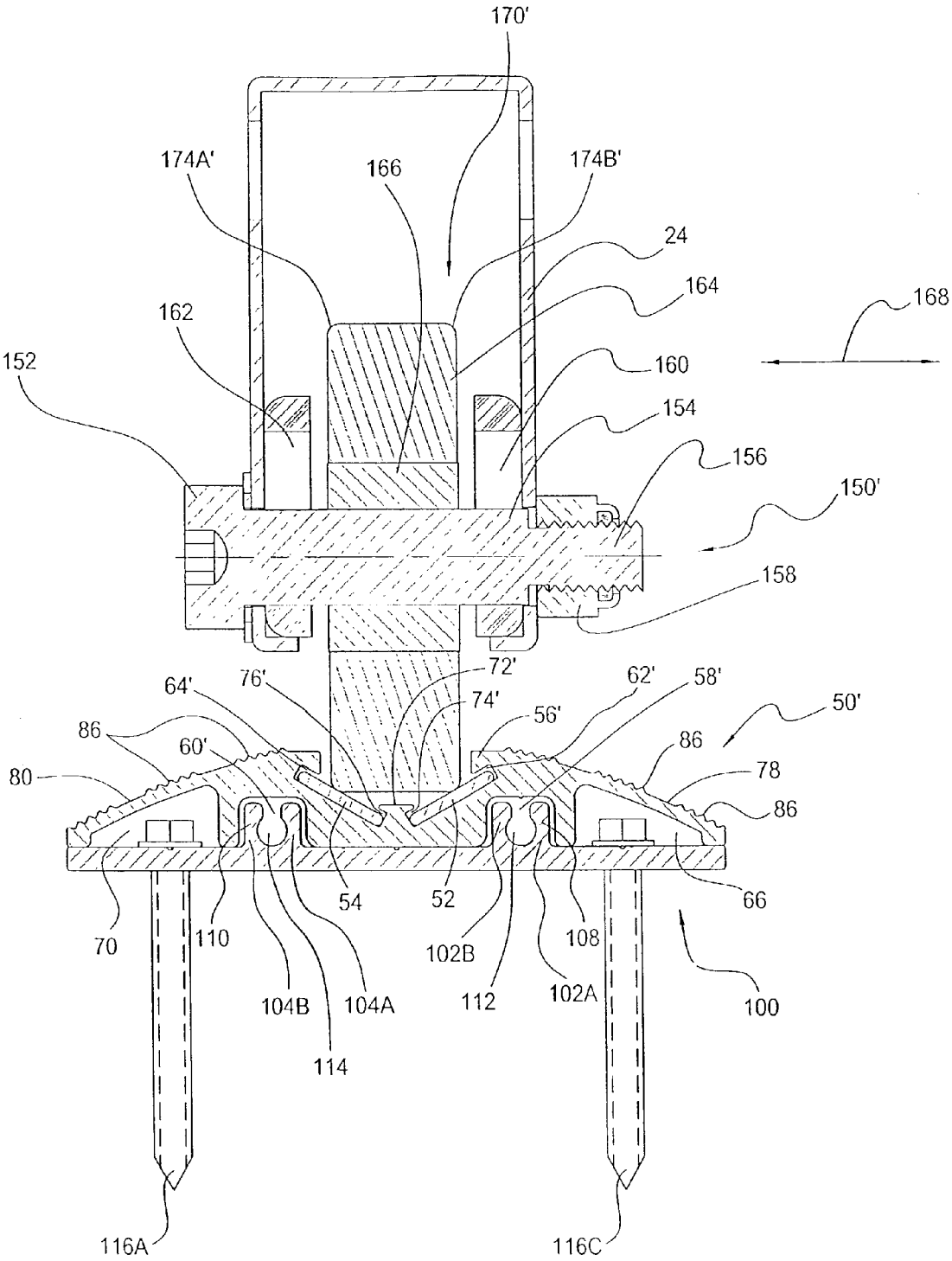
FIG. 10 is a sectional front elevation view of a second embodiment of a wheel assembly, track assembly and track support for the FIG. 2 mobile storage system.

The principal difference between the embodiments of FIG. 10 and FIG. 4 is that track assembly 50' and, specifically track member 56', are shaped differently in cross-section than track assembly 50 and track member 56. Track support 100 is identical in either embodiment. Components of the FIG. 10 embodiment which are substantially the same as corresponding components of the FIG. 4 embodiment bear the same reference numerals and need not be described further. Components of the FIG. 10 embodiment that are similar (but not identical) to corresponding components of the FIG. 4 embodiment bear the same reference numerals with an appended apostrophe.

Figure 11A:
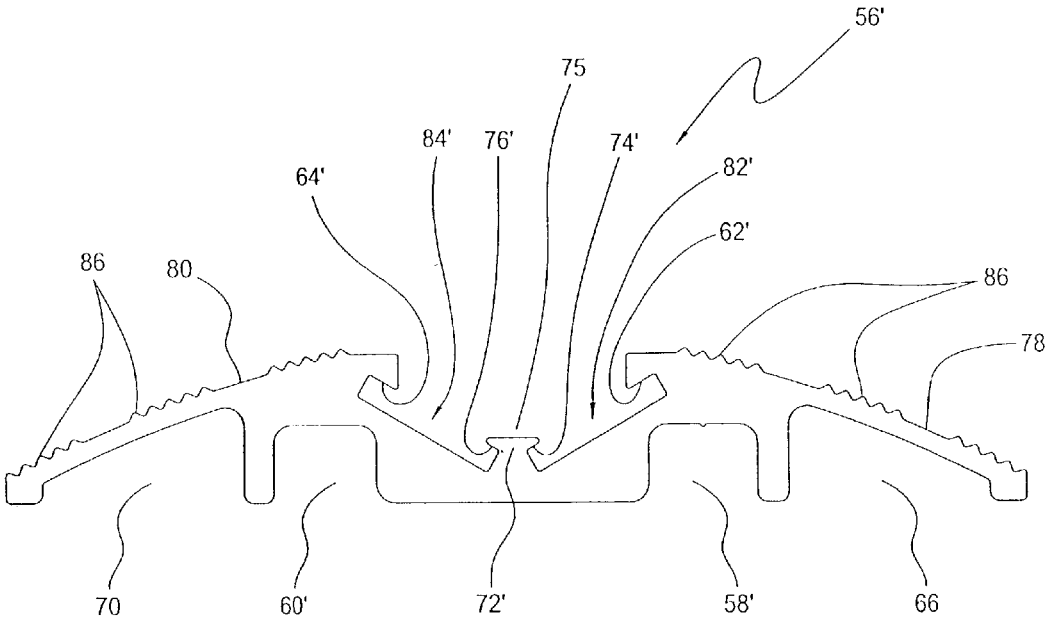
FIG. 11A is a front elevation view of the FIG. 10 track member.
Figure 11B:
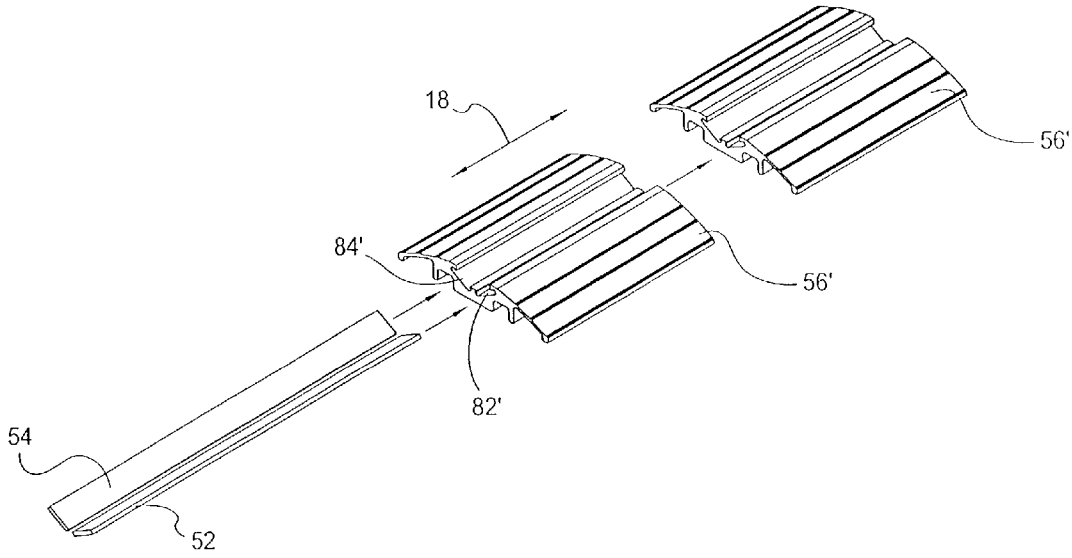
FIG. 11B is an isometric view of track members and steel strip insert components of the FIG. 10 apparatus.

Track member 56' is elongated in the direction of arrow 18 (see FIG. 11B). Like track member 56 (see FIG. 4), the top surface of track member 56' has two opposing downwardly and outwardly sloping surfaces 78, 80. However, as seen in FIGS. 10 and 11A, the top surface of track member 56' differs from that of track member 56 in that track member 56' is formed with a generally concave shaped recess 75, containing recessed head 72' and slots 82', 84' which are sloped inwardly and downwardly toward one another. Recess 75, recessed head 72' and slots 82', 84' extend longitudinally in the direction of arrow 18. A plurality of ridges 86 extend longitudinally along the tops of outwardly sloping surfaces 78, 80. Ridges 86 help users to grip the surface of track assembly 50' with the soles of their feet (i.e. when walking over and/or working in the vicinity of track assembly 50') and to avoid tripping or slipping on track assembly 50'.

Wear strips 52, 54 are slidably inserted into slots 82', 84' and secured in place by flanges 62', 74' and 64', 76' respectively (see FIG. 11A). As seen in FIG. 10, wheel assembly 150' rolls on wear strips 52, 54. Wear strips 52, 54 may also be used to join together and align adjacent sections of track member 56' (see FIG. 11B) by slidably inserting wear strips 52, 54 into slots 82', 84' of each of an opposed pair of end-butted track members 56', such that a portion of wear strips 52, 54 extend into slots 82', 84' of track member 56' across each side of the butt joint.

A pair of cavities 66, 70 (see FIG. 10) are formed in the under surface of track member 56'. These recesses are substantially the same and perform the same function as those of the FIG. 4 embodiment. Because of concave recess 75, track member 56' has no central recess in its under surface (see central recess 68 of FIG. 4).

A pair of longitudinally extending recesses 58', 60' are formed in the under surface of track member 56'. As with the FIG. 4 embodiment, recesses 58', 60' are sized and shaped for loose-fit projection of protrusions 108, 110 within, and extension along, recesses 58', 60', thereby permitting limited transverse movement of track member 56' with respect to track support 100.

Figure 12A:
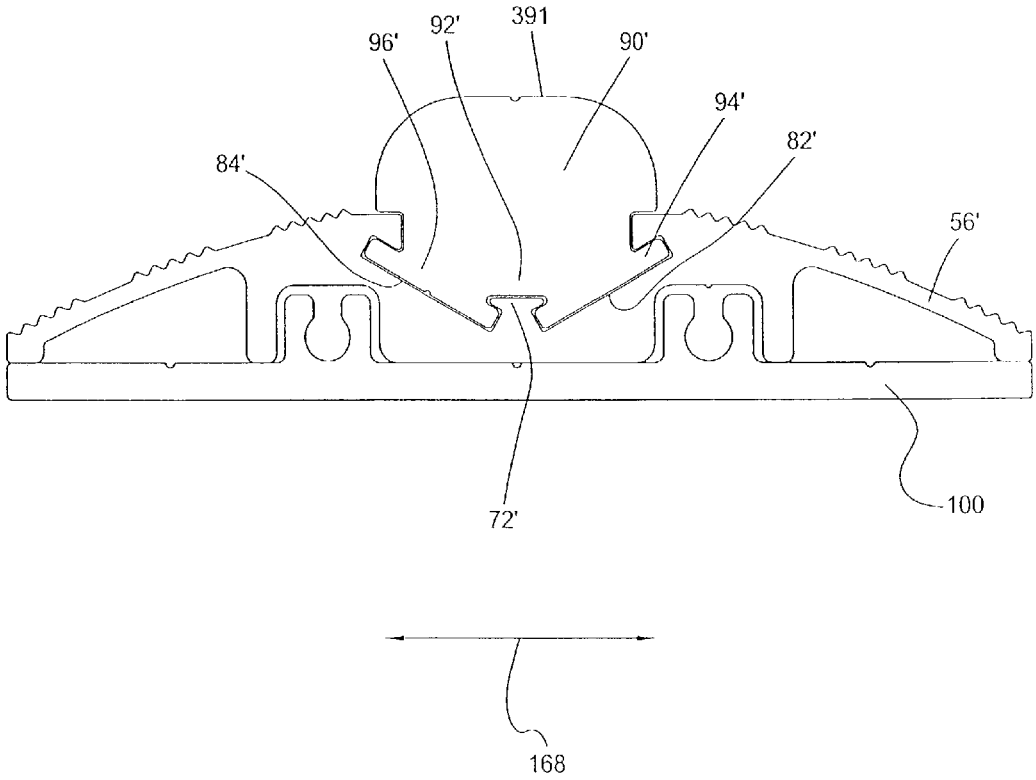
FIG. 12A is a front elevation view of track member, end-stop and track support components of the FIG. 10 apparatus.
Figure 12B:
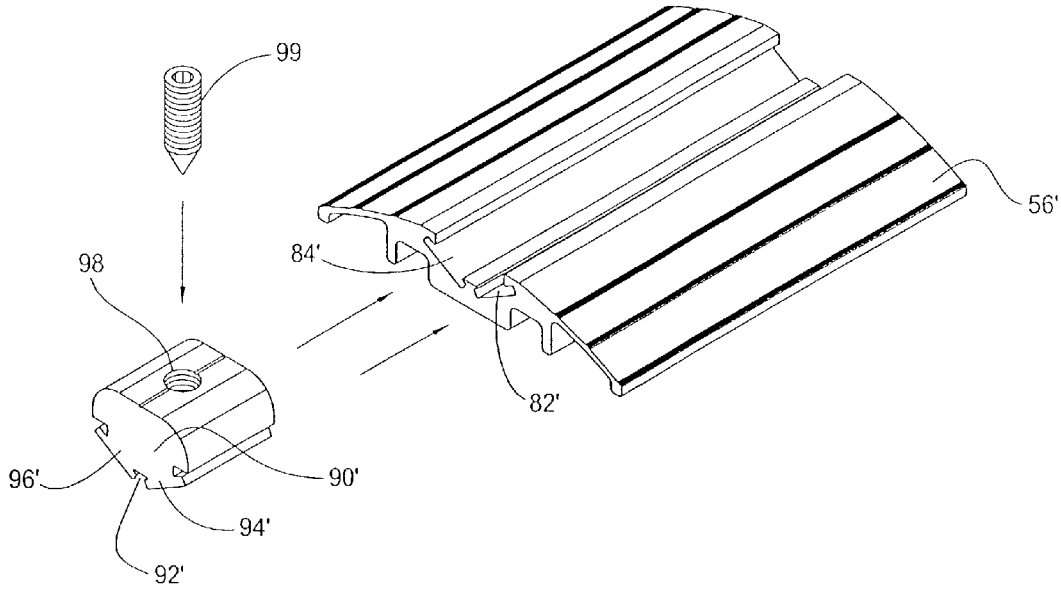
FIG. 12B is an isometric view of track member and end-stop components of the FIG. 10 apparatus.

As seen FIGS. 12A and 12B, end-stop 90' is similar to end-stop 90 (see FIGS. 7A and 7B). End-stop 90' has a top surface 91 and a bottom surface shaped to engage track member 56'. End-stop 90' differs from end-stop 90, in that recess 92' and two slanted legs 94', 96' of end-stop 90' are respectively sized and shaped to slide over recessed head 72' and into slots 82', 84' of track member 56'. The functionality and other features of end-stop 90' and are substantially the same as the features of end-stop 90.

Figure 13A:
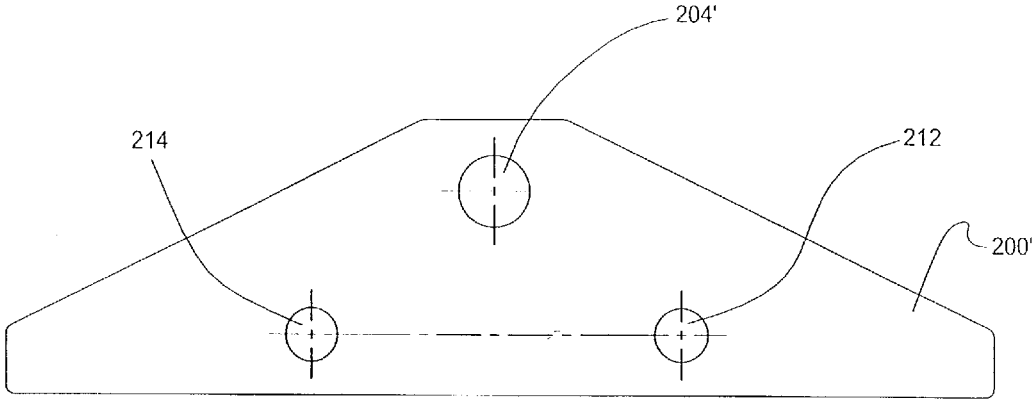
FIG. 13A is a front elevation view of an end-plate component of the FIG. 10 apparatus.
Figure 13B:
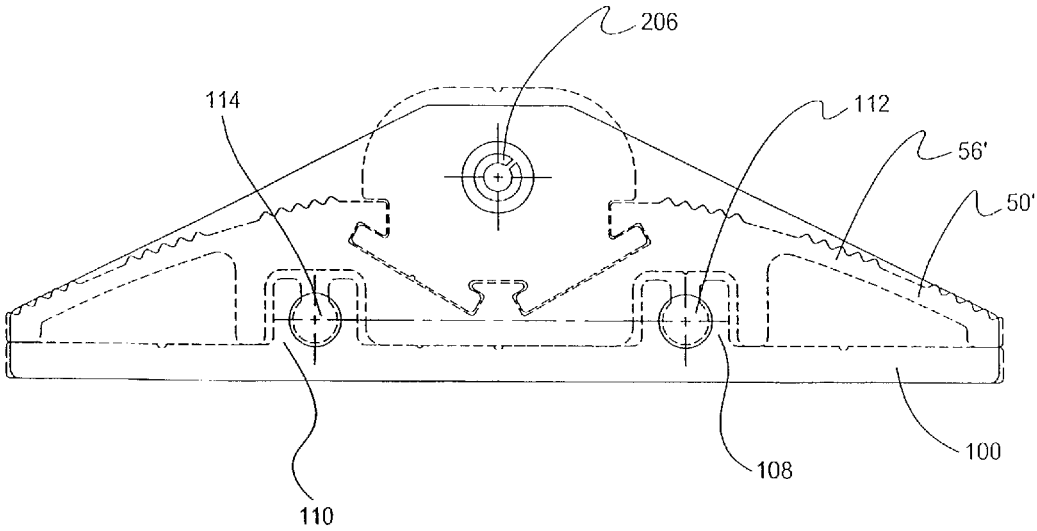
FIG. 13B is a partially sectioned front elevation view of end-plate, track support, track member and end-stop components of the FIG. 10 apparatus.
Figure 13C:
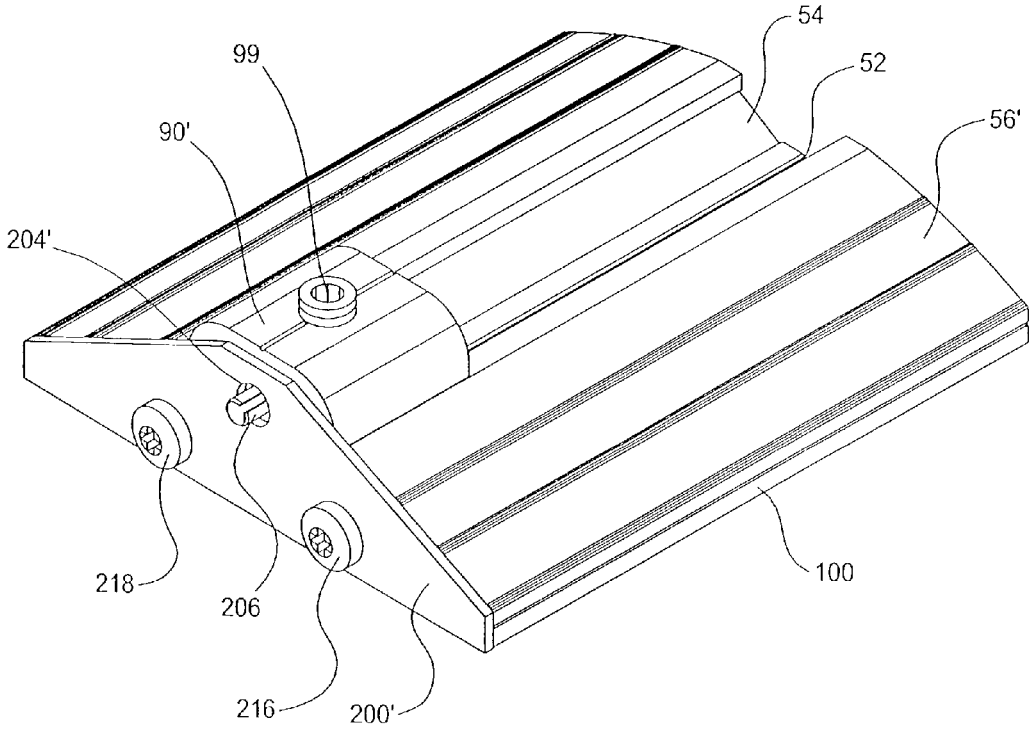
FIG. 13C is an isometric view of end-plate, track support, track member and end-stop components of the FIG. 10 apparatus.

As seen in FIGS. 13A, 13B and 13C end plate 200' can be provided to coincide or approximately coincide with the position of end-stop 90' and with the end of track assembly 50' and track support 100. Although end plate 200' is shaped slightly differently, it has similar features and functions in a manner similar to end plate 200 (see FIGS. 9A, 9B and 9C).

Wheel assembly 150' is similar to wheel assembly 150 (compare FIGS. 4 and 10), except that wheel assembly 150' has a circumferential rim 170' that is substantially flat in cross-section. The first and second circumferential sides 174A', 174B' of circumferential rim 170 have slightly bevelled corners, which roll along wear strips 52, 54. A small space remains between the lowermost portion of circumferential rim 170 and the uppermost portion of recessed head 72', such that rolling motion may occur without substantial contact between circumferential rim 170' and track member 56' at any points located away from first and second circumferential surfaces 174A', 174B'. With this configuration, the weight of mobile storage unit 10 rests on wear strips 52, 54 and no weight is borne by recessed head 72' of track member 56'.

As will be apparent to those skilled in the art in the light of the foregoing disclosure, many alterations and modifications are possible in the practice of this invention without departing from the spirit or scope thereof. The following potential modifications should be understood to be part of the current invention.

The embodiments discussed above have two tracks and are suitable for many applications. However, for heavy load applications, three or more substantially parallel wheel supporting members, having wheel assemblies which roll along three or more substantially parallel track assemblies can be provided. The additional wheel supports, wheels and track assemblies help to distribute the heavy load and to reduce wear over the components of the mobile storage system.

Track member 56 (depicted in FIG. 6A) includes a number of cavities 66, 68, 70 on its under surface that provide space for mounting fasteners 116A, 116B, 116C (see FIG. 4). Depending on the desired location and type of mounting screws 116A, 116B, 116C, the number, shape and locations of cavities 66, 68, 70 may vary. However, cavities 66, 68, 70 should not interfere with the transverse movement of track member 56 on track support 100. Similarly, in the embodiment of track member 56' depicted in FIG. 11A, the number, shape and locations of cavities 66, 70 may vary, provided that they do not interfere with the transverse movement of track member 56' on track support 100.

Track member 56 (depicted in FIG. 6A) and track member 56' (depicted in FIG. 11A) are shaped to have a very low profile in cross-section. This shape is advantageous, because it makes the tracks more difficult to trip over and allows them to be easily traversed by people in wheel-chairs, wheeled equipment etc. Notwithstanding these advantages, the cross-sectional shape of track members 56 and 56' could be varied without departing from the scope of the invention, provided that track members 56, 56' were able to move transversely on track supports 100. For example, track member 56 and track member 56' may be rectangular in cross-section.

Wheel assembly 150 (see FIG. 4) and wheel assembly 150' (see FIG. 10) are mounted in a bore of wheel supporting members 24 of the mobile storage unit 10 by axle bolts 152. One skilled in the art will appreciate that this wheel mounting technique is not unique. In general, the invention should be understood to include any method of rotatably fastening a wheel assembly to a supporting member of the mobile storage units.

The substantially semi-circular apertures 112, 114 in track support 100 (see FIGS. 4, 5A, 5B and 10) are shown to extend longitudinally through the entirety of protrusions 108, 110. In general, such apertures are only required at the ends of track supports 100 and need not extend longitudinally through the entirety thereof.

In some embodiments, it may be advantageous to construct track members 56, 56' and track supports 100 from steel or some other robust material. In such applications, the upper surfaces of track members 56, 56' may be sufficiently strong to support the weight of mobile shelving units 10 and steel strip inserts 52, 54 may not be required. One skilled in the art will appreciate that a track member may be made of sufficiently strong material, such that first and second circumferential sides of a circumferentially grooved wheel are positionable within a convex channel formed in the upper surface of the track member for rolling of the wheel along the track member without substantial contact between the wheel and the track member at points away from the first and second circumferential sides. Alternatively, a track member may be made such that a wheel having a flat circumferential rim is positionable within a concave channel formed in the upper surface of the track member without substantial contact between the between the wheel and the track member at points away from the first and second circumferential sides.

Figure 14:
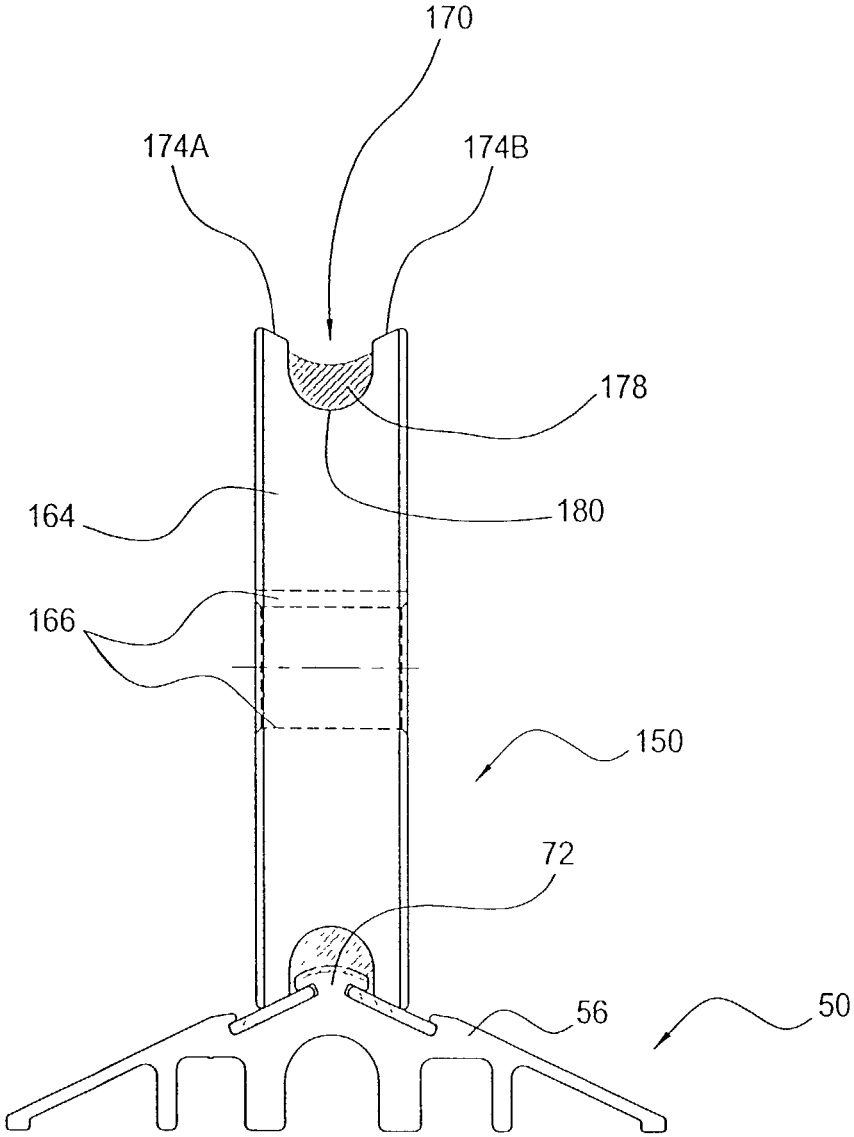
FIG. 14 is a sectional front elevation view of an alternative wheel assembly for the FIG. 4 apparatus.
Figure 15:
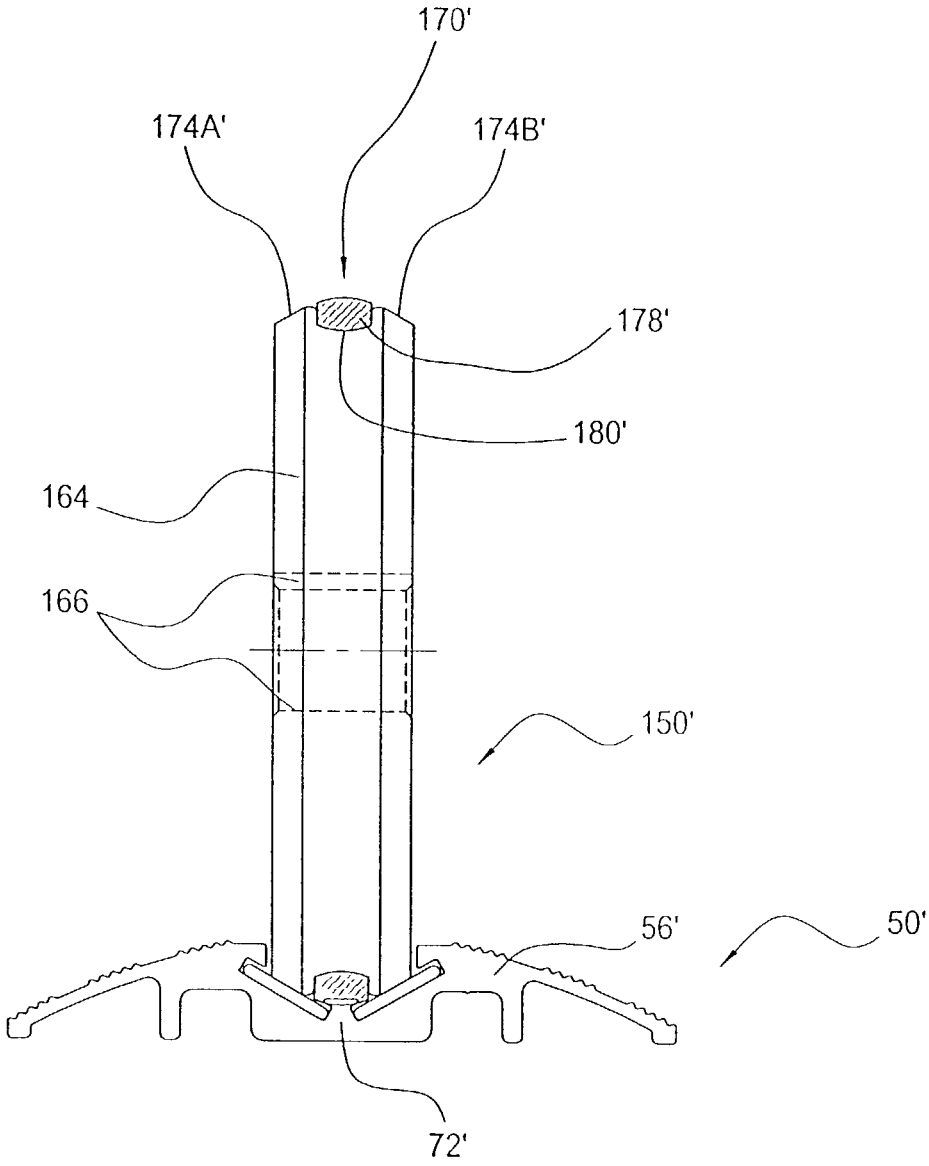
FIG. 15 is a sectional front elevation view of an alternative wheel assembly for the FIG. 10 apparatus.

FIG. 14 depicts an alternative embodiment of wheel assembly 150, in which annularly-shaped, elastomeric ring 178 is inserted into circumferential recess 180 of wheel body 164, so as to circumferentially surround the wheel. As shown in FIG. 14, recess 180 is deeper (as compared to recess 172 of the embodiment of FIG. 8) to accommodate ring 178. As wheel assembly 150 rolls on track member 56, elastomeric ring 178 contacts head 72, creating a small amount of friction. This prevents slippage of wheel assembly 150 with respect to track member 56 that might otherwise occur under light load conditions. FIG. 15 depicts an elastomeric ring 178' that may be used with the embodiment of FIG. 10. Elastomeric ring 178' is inserted into a circumferential groove 180' (not present in the embodiment of FIG. 10) and frictionally engages recessed head 72' to prevent slippage of wheel assembly 150' with respect to track member 56' that might otherwise occur under conditions of light load.

The scope of the invention is to be construed in accordance with the substance defined by the following claims.

What is claimed is:

1. A mobile storage system track, comprising:

(a) a longitudinally extending track support;

(b) at least one protrusion projecting above, and extending longitudinally along, an upper surface of said track support;

(c) a longitudinally extending track member; and, (d) at least one recess within, and extending longitudinally along, an under surface of said track member, said recess sized and shaped for loose-fit projection of said protrusion within, and extension along, said recess when said track member is laid atop said track support, said loose-fit projection of said protrusion within, and extension along, said recess providing a transverse space between at least one longitudnally extending edge of said recess and a closest longitudinally extending edge of said protrusion and permitting limited transverse movement of said track member with respect to said track support.

2. A mobile storage system track as defined in claim 1, further comprising first and second longitudinally extending parallel slots within, and extending longitudinally along, an upper surface of said track member.

3. A mobile storage system track as defined in claim 2, said track member upper surface having a transverse cross-sectional shape wherein said slots are sloped outwardly and downwardly away from one another.

4. A mobile storage system track as defined in claim 3, further comprising first and second longitudinally extending wear strips longitudinally insertable into said first and second slots respectively.

5. A mobile storage system track as defined in claim 3, further comprising a wheel having a circumferentially grooved rim extending between spaced apart inwardly bevelled first and second circumferential sides of said wheel, said first and second sides positionable within said first and second slots respectively for rolling of said wheel along said track member without substantial contact of said rim with said track member at points on said rim away from said first and second sides.

6. A mobile storage system track as defined in claim 2, said track member upper surface having a transverse cross-sectional shape wherein said slots are sloped inwardly and downwardly toward one another.

7. A mobile storage system track as defined in claim 6, further comprising first and second longitudinally extending wear strips longitudinally insertable into said first and second slots respectively.

8. A mobile storage system track as defined in claim 6, further comprising a wheel having a flat circumferential rim extending between spaced apart first and second circumferential sides of said wheel, said first and second sides positionable within said first and second slots respectively for rolling of said wheel along said track member without substantial contact of said rim with said track member at points on said rim away from said first and second sides.

9. A mobile storage system track as defined in claim 1, further comprising a wheel having a cumferentially grooved rim extending between spaced apart inwardly bevelled first and second circumferential sides of said wheel, said first and second sides positionable atop a convex surface formed in said track member upper surface, for rolling of said wheel along said track member without substantial contact of said rim with said track member at points on said rim away from said first and second sides.

10. A mobile storage system track as defined in claim 1, further comprising a wheel having a flat circumferential rim extending between spaced apart first and second circumferential sides of said wheel, said first and second sides positionable within a concave channel formed in said track member upper surface, for rolling of said wheel along said track member without substantial contact of said rim with said track member at points on said rim away from said first and second sides.

11. A mobile storage system track as defined in claim 1, further comprising:

(a) a first plurality of said track supports longitudinally aligned with one another and mounted on a support surface; and, (b) a second plurality of said track members longitudinally aligned with one another and laid atop said respective track supports with said respective track support protrusions projecting loosely within said respective track member recesses, permitting limited transverse movement of said track members with respect to said track supports.

12. A mobile storage system track as defined in claim 11, further comprising first and second longitudinally extending parallel slots within and extending longitudinally along an upper surface of each one of said track members.

13. A mobile storage system track as defined in claim 12, said track member upper surfaces each having a transverse cross-sectional shape wherein said slots are sloped outwardly and downwardly away from one another.

14. A mobile storage system track as defined in claim 13, further comprising pluralities of first and second longitudinally extending wear strips longitudinally insertable into said first and second slots respectively.

15. A mobile storage system track as defined in claim 14, further comprising a plurality of wheels, each said wheel having a circumferentially grooved rim extending between inwardly bevelled spaced apart first and second circumferential sides of said wheel, said first and second sides positionable within said first and second slots respectively for rolling of said wheel along said track member without substantial contact of said rim with said track member at points on said rim away from said first and second sides.

16. A mobile storage system track as defined in claim 15, further comprising a selected plurality of said wheels rotatably coupled to a mobile storage unit for rolling movement of said storage unit along said mobile storage system track.

17. A mobile storage system track as defined in claim 12, said track member upper surfaces each having a transverse cross-sectional shape wherein said slots are sloped inwardly and downwardly toward one another.

18. A mobile storage system track as defined in claim 17, further comprising pluralities of first and second longitudinally extending wear strips longitudinally insertable into said first and second slots respectively.

19. A mobile storage system track as defined in claim 18, further comprising a plurality of wheels, each said wheel having a flat circumferential rim extending between spaced apart first and second circumferential sides of said wheel, said first and second sides positionable within said first and second slots respectively for rolling of said wheel along said track member without substantial contact of said rim with said track member at points on said rim away from said first and second sides.

20. A mobile storage system track as defined in claim 19, further comprising a selected plurality of said wheels rotatably coupled to a mobile storage unit for rolling movement of said storage unit along said mobile storage system track.

21. A mobile storage system according to claim 11, wherein the limited transverse movement is within a range of about 1–5 mm.

22. A mobile storage system track as defined in claim 1, wherein the limited transverse movement of said track member with respect to said track support is in a range between 1–5 mm.

23. A mobile storage system track, comprising:

(a) a longitudinally extending track support;

(b) at least one protrusion projecting above, and extending longitudinally along, an upper surface of said track support;

(c) a longitudinally extending track member;

(d) at least one recess within, and extending longitudinally along, an under surface of said track member, said recess sized and shaped for loose-fit projection of said protrusion within, and extension along, said recess when said track member is laid atop said track support, permitting limited transverse movement of said track member with respect to said track support; and, (e) a plurality of fasteners for fastening said track support to a support surface, each one of said fasteners having a flange for bearing against a non- width reduced portion of said track support.

24. A mobile storage system track as defined in claim 23, said track member further comprising a plurality of cavities in said track member under surface, each one of cavities sized and shaped to receive a head portion of one of said fasteners.

25. A mobile storage system track, comprising:

(a) a longitudinally extending track support;

(b) at least one protrusion projecting above, and extending longitudinally along, an upper surface of said track support;

(c) a longitudinally extending track member;

(d) at least one recess within, and extending longitudinally along, an under surface of said track member, said recess sized and shaped for loose-fit projection of said protrusion within, and extension along, said recess when said track member is laid atop said track support, permitting limited transverse movement of said track member with respect to said track support;

(e) first and second longitudinally extending parallel slots within, and extending longitudinally along, an upper surface of said track member; and, (f) a cavity within and extending longitudinally along said protrusion.

26. A mobile storage system track as defined in claim 25, further comprising a spring clip having a first end insertable within said cavity of a first one of said track supports and having a second end insertable within said cavity of a second one of said track supports, said first and second track supports positioned to longitudinally align said respective cavities.

27. A mobile storage system track as defined in claim 26, further comprising:

(a) a first wear strip having a first end insertable within said first slot of a first one of said track members and having a second end insertable within said first slot of a second one of said track members;

(b) a second wear strip having a first end insertable within said second slot of said first one of said track members and having a second end insertable within said second slot of said second one of said track members;

said first and second track members positioned to longitudinally align said first track member first slot with said second track member first slot and to longitudinally align said first track member second slot with said second track member second slot.

28. A mobile storage system track as defined in claim 25, further comprising an end-stop sized and shaped for mating engagement within at least one of said slots of a selected one of said track members.

29. A mobile storage system track as defined in claim 28, wherein said end-stop is fastenable to said selected one of said track members.

30. A mobile storage system track as defined in claim 29, said end-stop first comprising an elastomeric cushioning member.

31. A mobile storage system track as defined in claim 30, said end-stop further comprising a longitudinally extending stud.

32. A mobile storage system track as defined in claim 31, further comprising an end plate fastenable to an end of a selected one of said track supports.

33. A mobile storage system track as defined in claim 32, said end plate having an aperture sized and positioned for projection of said end-stop stud into said end plate aperture.

34. A mobile storage system as defined in claim 25, further comprising first and second longitudinally extending wear strips longitudinally insertable into said first and second slots respectively.

35. Mobile storage apparatus, comprising:

(a) a plurality of substantially parallel, longitudinally extending track supports fastened to a surface at spaced apart locations, each track support comprising at least one protrusion projecting above, and extending longitudinally along an upper surface of said track support;

(b) a plurality of longitudinally extending track members, each one of said track members comprising at least one recess within, and extending longitudinally along an under surface of said one of said track members, said recess sized and shaped for loose-fit projection of a corresponding one of said protrusions within and extension along said recess when said one of said track members is laid atop a corresponding one of said track supports, said loose-fit projection of the corresponding one of said protrusions within and extension along said recess providing a transverse space between at least one longitudinally extending edge of said recess and a closest longitudinally extending edge of the corresponding one of said protrusions and permitting limited transverse movement of said one of said track members with respect to said corresponding one of said track supports; and, (c) a mobile storage unit comprising a plurality of rotatably mounted wheels, each one of said wheels sized and shaped for rolling of said one of said wheels along an upper surface of said track members.

36. A method of permitting rolling longitudinal movement and limited transverse movement of a mobile storage unit with respect to a track, said method comprising:

(a) mounting a longitudinally extending track support on a support surface;

(b) projecting an upper surface of said track support upwardly to provide a longitudinally extending protrusion on said track support, said longitudinally extending protrusion having a first width;

(c) inwardly recessing an under surface of a track member to provide a longitudinally extending recess in said track member, said longitudinally extending recess having a second width greater than said first width; and, (d) laying said track member atop said track support while guiding said longitudinally extending protrusion into said longitudinally extending recess, wherein laying said track member atop said track support while guiding said longitudinally extending protrusion into said longitudinally extending recess further comprises providing a transverse space between at least one longitudinally extending edge of said recess and a closest longitudinally extending edge of said protrusion, thereby permitting limited transverse movement of said longitudinally extending protrusion within said longitudinally extending recess and corresponding limited transverse movement of said track member with respect to said track support.

37. A method as defined in claim 34, further comprising longitudinally slotting said upper surface of said track member along transversely opposed longitudinally extending portions of said upper surface of said track member.

38. A method as defined in claim 37, further comprising providing a longitudinally extending replaceable wear absorber on each of said transversely opposed longitudinally extending portions of said upper surface of said track member.

39. A method as defined in claim 37, further comprising sloping said transversely opposed longitudinally extending portions of said upper surface of said track member outwardly and downwardly away from one another.

40. A method as defined in claim 39, further comprising:

(a) circumferentially grooving a wheel between first and second circumferential sides of said wheel;

(b) inwardly bevelling first and second circumferential sides of said wheel;

(c) rotatably mounting said wheel on said mobile storage unit; and, (d) positioning said first and second circumferential sides of said wheel on said transversely opposed longitudinally extending portions of said upper surface of said track member respectively.

41. A method as defined in claim 37, further comprising sloping said transversely opposed longitudinally extending portions of said upper surface of said track member inwardly and downwardly toward one another.

42. A method as defined in claim 41, further comprising:

(a) providing a wheel having a flat rim extending circumferentially between first and second circumferential sides of said wheel;

(b) rotatably mounting said wheel on said mobile storage unit; and, (c) positioning said first and second circumferential sides of said wheel on said transversely opposed longitudinally extending portions of said upper surface of said track member respectively.

* * * * *